United States Patent [19]

Hilton

[11] 4,275,667

[45] Jun. 30, 1981

[54] SHEET COUNTING APPARATUS

[75] Inventor: Graham H. Hilton, Lovedean, England

[73] Assignee: De La Rue Systems Limited, London, England

[21] Appl. No.: 100,479

[22] Filed: Dec. 5, 1979

[30] Foreign Application Priority Data

Dec. 8, 1978 [GB] United Kingdom ..... 47673/78

[51] Int. Cl.[3] ..... E05G 3/00

[52] U.S. Cl. ..... 109/44; 109/39; 217/62; 220/260

[58] Field of Search ..... 109/38, 39, 23 R, 45, 109/50, 51, 52, 44; 220/260; 217/62; 232/7

[56] References Cited

U.S. PATENT DOCUMENTS

| | | | |
|---|---|---|---|
| 354,277 | 12/1886 | Walker | 217/62 |
| 3,559,593 | 2/1971 | Munton | 109/44 |
| 3,854,655 | 12/1974 | Armstrong | 109/23 |
| 4,162,024 | 7/1979 | Shanley | 217/62 |
| 4,186,977 | 2/1980 | Gilovich | 109/52 |
| 4,195,579 | 4/1980 | Doyel | 109/52 |

*Primary Examiner*—Reinaldo P. Machado
*Attorney, Agent, or Firm*—Frost & Jacobs

[57] ABSTRACT

The invention relates to a cassette particularly for bank notes. The object of the invention is to provide a cassette which will give an indication if it is tampered with.

The cassette has a shutter which can be opened to remove the contents and mechanism to move the shutter from a first position to a second position when actuated by an external actuator means. When the external actuator is removed the mechanism automatically returns the shutter to the first position. Means are provided to prevent further movement of the shutter after it has returned to the first position.

In the drawings (FIG. 5), shutter 12 is actuated by rods 30 acting against the tension of spring 26.

The shutter is held against movement by latch 44 engaging bar 24. When key 57 is turned through 180°, end 51 of bar 50 lifts latch 44 against spring pressure to allow shutter 12 to be opened by rods 30. Bar 50 is held in this position by engagement of rod 46 in slots 52, but is released as the shutter opens and spring 54 returns bar 50 to position shown in FIG. 5. When shutter is closed latch 44 holds it closed and the shutter cannot be opened again thus indicating that it has been used once, or tampered with.

16 Claims, 11 Drawing Figures

SHEET COUNTING APPARATUS

This invention relates to cassettes adapted to house stacks of flexible sheets and more especially to such cassettes capable of containing sheets in a secure manner, which sheets may for example, comprise banknotes or like articles having a high intrinsic value.

More especially, the invention has utility in relation to integrated money handling systems, to protect banknotes during storage, transit and subsequent use.

It is to be appreciated that such cassettes per se are incapable of resisting attack by a determined thief, who may for example remove them and/or employ metal cutting apparatus to gain access to the interior thereof. An object of the invention is to provide a pilfer-proof lockable cassette together with a means to provide an indication if its contents are tampered with.

In an integrated money handling system full advantage may be taken of mechanical devices to facilitate the loading of cassettes with a predetermined quantity of banknotes. For example, this may be carried out at the cash centre of a Banking Organisation and the loading may be effected by a mechanical stacking device of well known type which may comprise the output stage of a banknote-condition verifying machine.

The unloading of the cassettes in an integrated money system is advantageously carried out by an automatic banknotes dispenser also of well known type.

It will therefore be appreciated that the overall efficiency and security of such a system may be enhanced by the use of a cassette which may be locked to a pre-set condition after it has been filled at the cash centre, so as to remain in this condition until it has been introduced into the dispenser. As mentioned above, a desirable feature of the invention resides in the provision of means to indicate if the contents of the cassette have been tampered with during storage and transport, and accordingly, if there is no such indication the actual quantity of banknotes loaded into the dispenser may be ascertained directly from information provided by the cash centre.

During operation of a cash dispenser it may be necessary to withdraw a partially used cassette, for example in order to substitute a cassette containing banknotes of a different denomination. Furthermore, it may be necessary to remove a cassette because of a mechanical failure of the dispenser or to clear a jam in the feeding mechanism, for example as may be created by the passage of a mutilated banknote. For conditions of security it is therefore desirable to safeguard the contents of a cassette removed for any of the above reasons and it is a special feature of the invention to provide means which serve automatically to relock the cassette and thereafter prevent its re-insertion without additional authorisation.

According to the present invention, a security cassette comprises:

(a) a casing adapted to encompass a stack of sheets;

(b) a support means to support a stack of sheets within said casing;

(c) a sheet-access aperture within a wall of said casing to permit transmission of said sheets into and out of the cassette;

(d) movable shutter means, adapted when in a first position to obstruct said aperture and when in a second position to permit said transmission of sheets;

(e) mechanism to move said shutter means from said first position to said second position when actuated by external actuating means, said mechanism being arranged to return the shutter means from the second position to the first position when said external actuating means is removed;

(f) latching means to prevent further movement of said shutter means after its return to said first position; and (g) manually operable means to release said latching means.

The said movable shutter means may be of any suitable type and may be adapted to conform with a particular sheet handling machine. For example, it may comprise one or more pivotally mounted flaps or door panels disposed on vertical or horizontal axes and which may be arranged to move externally of the stack of sheets. Alternatively, one or more door panels may be arranged to slide in a direction parallel to the front face of the stack. Alternatively again, the shutter means may be of flexible or slatted construction, and in a preferred embodiment of the invention it comprises an assembly of side-interlocking strips, the ends of which are adapted to slide between parallel channel-sectioned guideways. In a practical construction the latter components are each provided with an intermediate 90° bend, thereby to enable the shutter to move initially along a path parallel to the face of the stack and thence in a direction at right angles to said face.

In a preferred embodiment of the invention the shutter means is spring biassed to its first i.e. closed) position and the said actuating means comprises a pair of parallel rods which are cantilevered from a face of a sheet handling machine, the extremities of the rods being arranged to enter into the interior of the cassette via clearance holes formed in the front thereof. In operation, during introduction of the cassette into the sheet handling machine, the said rods pass through said holes and engage a slidable transverse bar to which is attached a part of the shutter means. Accordingly, forward movement of the cassette during its introduction into the sheet handling machine progressively moves the shutter to its second (viz. open) position. Conversely, withdrawal of the cassette permits the return of the shutter to its closed initial position.

Preferably, the latching means comprises a spring-biassed pawl which is arranged to engage with a component adapted for movement with said shutter means.

Preferably, the said manually operable means comprises a conventional key-operated lock so arranged that the use thereof frees the latching means. In a specific construction a spring-biassed slidable bar is arranged to free the inter-engagement between the pawl and said component during operation of the key and thereafter to be retained by inter-engagement between the bar and the pawl thereby to pre-set the latching mechanism. To provide additional security a second key-operated lock, together with a second associated slidable bar may be provided, the arrangement necessitating the use of two keys to pre-set the mechanism for use or to gain access to the interior of the cassette.

Preferably, indicator means are provided to inform a user that the latching mechanism is in a pre-set condition. Conveniently this is effected by means of a colour coded device which is attached to a movable part of the latching mechanism and is visible through a suitable aperture formed in the casing of the cassette. Furthermore, audible indicator means may be provided to create a sound upon the transition of the latching means from its pre-set to its latched condition. This may be effected by a relatively movable bell and striker arranged to create a sound upon movement of the latching mechanism.

Preferably, the cassette is provided with a movable lid component to permit internal access. The said lid may be locked by conventional key means, or more conveniently it may be locked automatically when the shutter means is in its first (i.e. closed) position.

Preferably, the cassette is provided with a spring-biassed pressure plate adapted to move longitudinally along suitable guideways thereby to bias the stack in a direction towards said aperture.

Preferably, lateral control means are provided to guide the side edges of sheets within the stack thereby to maintain register of the sheets during transportation of the cassette. Conveniently said means comprises longitudinal strips mounted within the cassette in an adjustable manner, for example by means of screws within the cassette in an adjustable manner, for example by means of screws within associated slotted holes, thereby to enable a range of sheet sizes to be accommodated.

Figures 3, 3A:
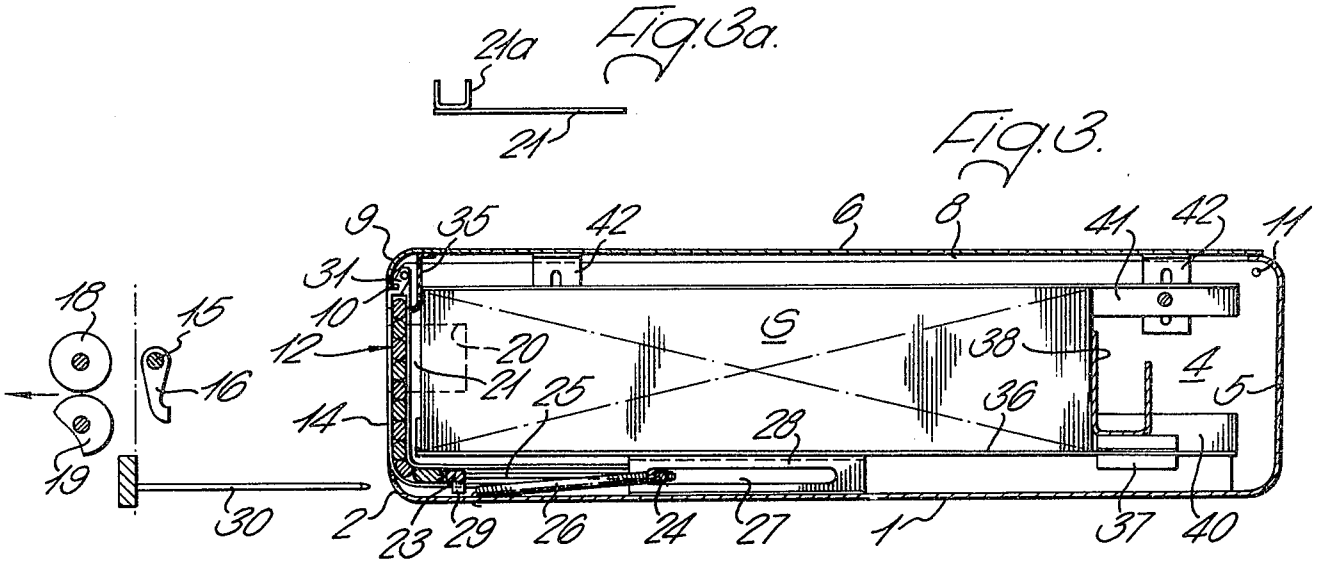
FIGS. 3 and 4 are schematic sectional elevations of the cassette shown in closed and open conditions, respectively.
Figure 4:
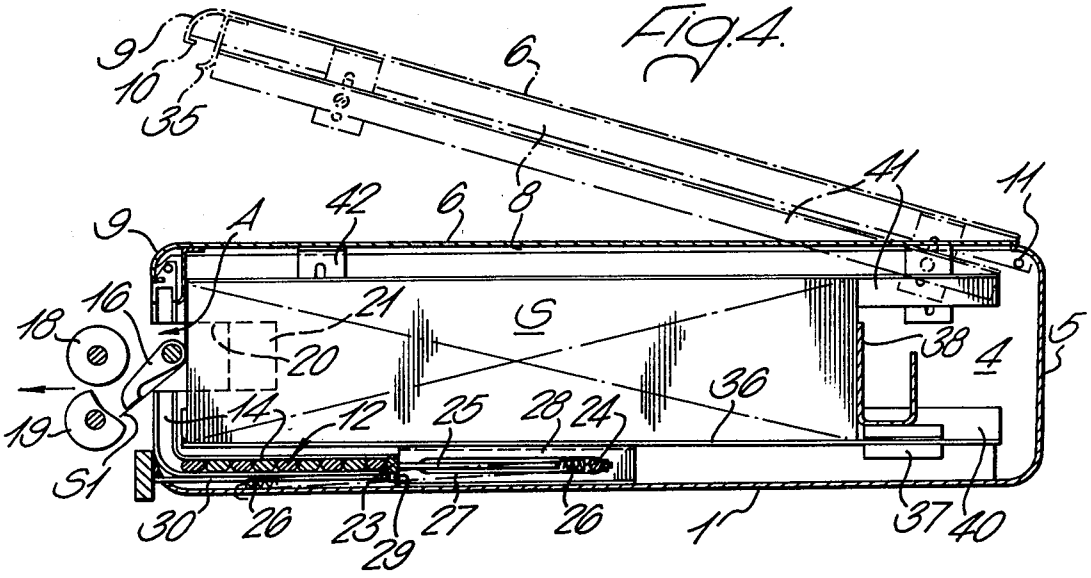
Figure 5:
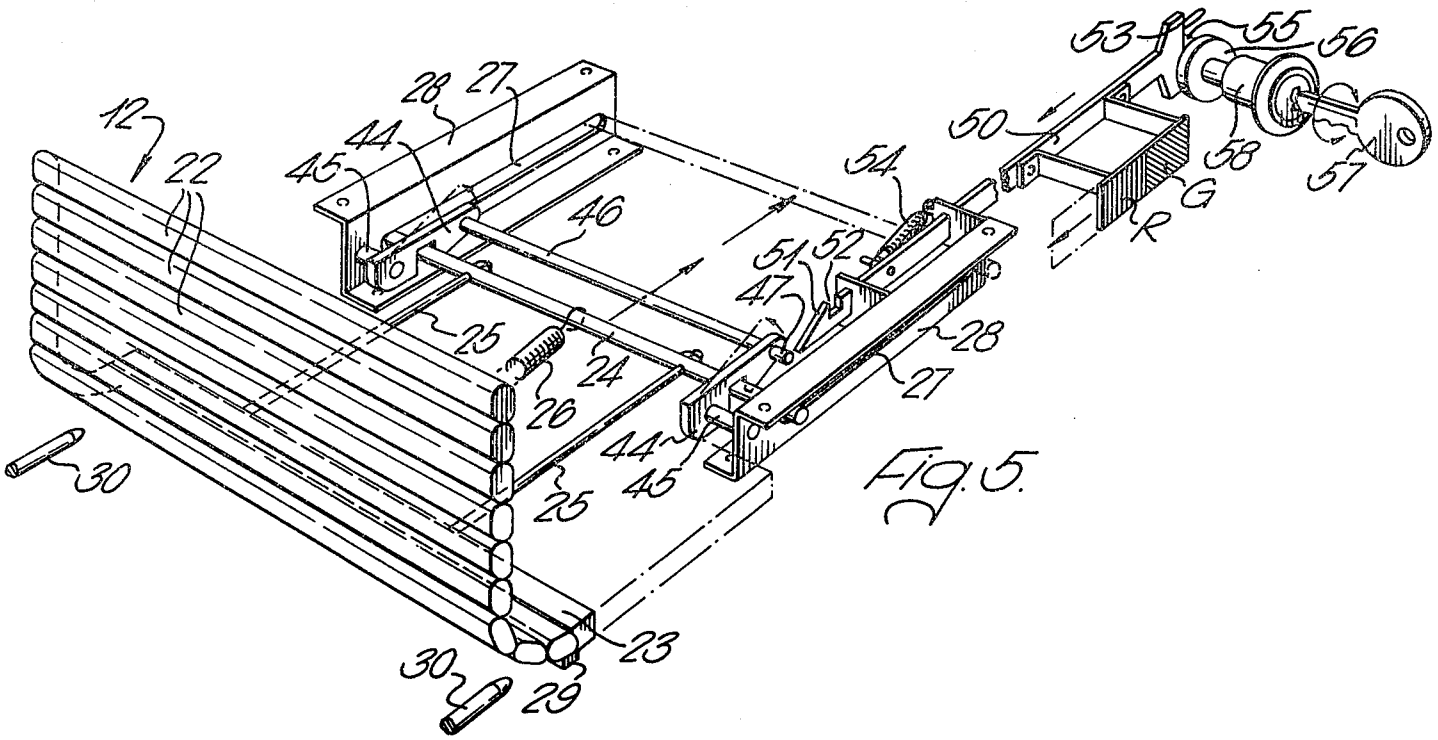
Figure 7:
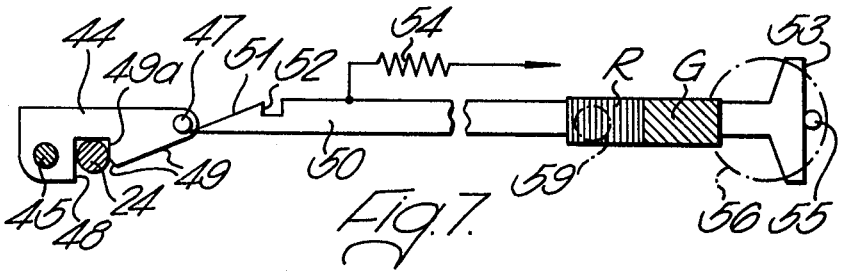
Figure 8:
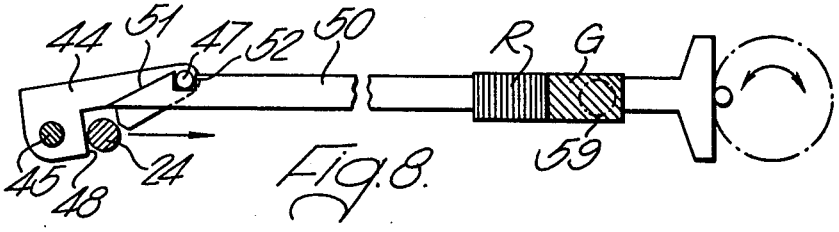
Figure 9:
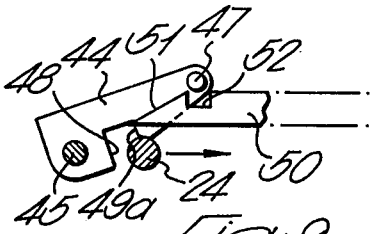
Figure 6:
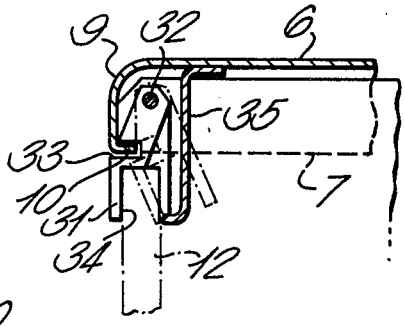
Figure 10:
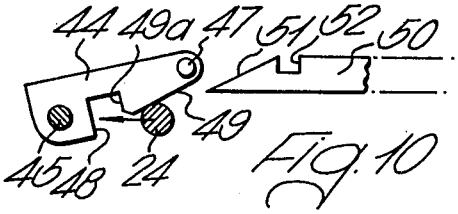

FIG. 3*a* is a section through a slidable plate;

FIG. 5 is a perspective view of the latching and locking mechanism of the cassette;

FIG. 6 is a fragmentary section of the lid-locking mechanism of the cassette drawn to an enlarged scale, and FIGS. 7–10 are schematic side elevations of parts of the mechanism of FIG. 4 shown in different operative positions.

The cassette comprises a welded sheet metal box of generally rectangular configuration made up from a base plate 1 (FIG. 3) having a curved frontal edge 2, a pair of side panels 3 and 3, and a rear panel 5. The upper surface of the cassette is defined by a lid panel 6 having a pair of side flanges 7 and 8 and a curved frontal portion 9 which terminates at an inwardly directed lip 10. The lid is hinged to the side panels by pivot pins 11 so as to open in the manner indicated by the chain-dotted lines in FIG. 4. The front of the cassette is provided with an aperture A to permit removal of banknotes by the means described below.

Figure 1:
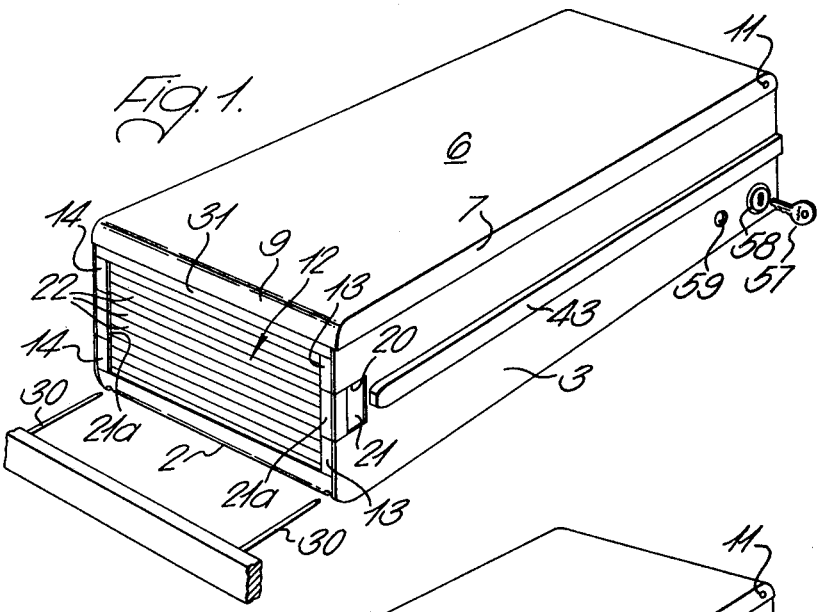
FIG. 1 is a perspective view of a cassette, embodying the present invention, the cassette being in its closed condition, together with a fragmentary view of an opening mechanism associated with a banknote dispensing machine.
Figure 2:
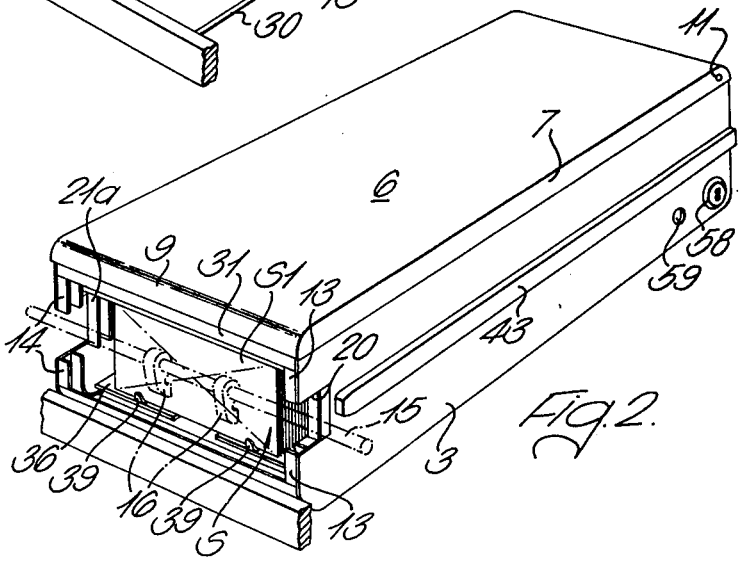
FIG. 2 is a similar view of the cassette but shown in its open condition and positioned effectively to cooperate with the feeding means of the machine.

The aperture A is provided with a slatted type shutter generally indicated by symbol 12, which seals the cassette when in a closed condition (see FIGS. 1 and 3) and is adapted for downward and rearward movement between a pair of channel-sectioned guideways 13 and 14 thereby to open the aperture (FIGS. 2 and 4).

The cassette described in the particular embodiment is intended for use with a sheet handling machine having a vacuum sheet feeder of the oscillating arm type. An example of such a feeder is described in British Pat. No. 989715 and which essentially includes an oscillatory shaft 15 upon which is mounted a pair of suction arms 16 having suction port faces 17 which engage the lower part of the frontmost banknote S1 in the stack S and move it into a seizing nip formed by two driven rollers 18 and 19 (see FIGS. 3 and 4). The roller 19 is provided with a deeply cut-away periphery to provide clearance for the edge of the banknote removed by the arms. Thereafter the seizing nip is established and the banknote is withdrawn from the stack. From FIGS. 2 and 4 it will be seen that it is necessary to site the feeding arms within the boundary of the cassette to enable them to act upon the face of the stack in the intended manner, and to provide a suitable working clearance for shaft 15 a cut-away slot 20 is formed in each of the side panels 3 and 4 in the manner shown. The said slots are shrouded by respective spring-biassed slidable plates 21 which are adapted to retract upon insertion of the cassette into the dispenser. It will be seen from FIG. 2, and from FIG. 3*a*, that portions of the channel guideways 21*a* are attached to the inner frontal edges of the plates 21, but this is of no consequence because the shutter is opened prior to the engagement of the suction arms.

The sliding shutter 12 comprises a plurality of side-edge interlocking strips 22 which terminate at an anchor strip 23, which is in turn connected to a transverse bar member 24 by means of a pair of screwed tie rods 25 (see FIG. 5). The bar member 24 is biassed in a leftward direction by means of a tension spring 26, and the ends of bar 24 are guided within slots 27 formed in flanged brackets 28. The anchor strip 23 is provided with depending lugs 29 (see FIGS. 3 and 4) which form abutment faces for a pair of shutter-actuating rods 30 which are fixedly mounted to a part of the feeding mechanism of the dispenser, and enter into the interior of the cassette through clearance holes formed in the curved frontal edge 2 of the base plate 1. FIGS. 1 and 3 show the cassette approaching the actuating rods 30 and in FIGS. 2 and 4 the said rods have contacted the lugs 29 thereby retracting the shutter 12.

The means for locking the lid of the cassette will now be described with reference to FIG. 6 which depicts an enlarged view of the top left hand corner of the casing shown in FIGS. 3 and 4. Disposed between the corner extremities of the side panels, and pivotally mounted thereto, is a bridge piece 31 disposed on a transverse shaft 32. The said bridge piece includes a side groove 33 which is adapted to receive the lip 10 of the lid panel and a lower groove 34 to receive a part of the upper strip of the shutter assembly. Disposed inwardly of the bridge piece 31 there is provided a flanged bracket 35 which is welded to the underside of the lid and serves as an upper front support for the stack of banknotes and also as a stop to control rotation of the bridge piece. The bridge piece is spring-biassed (by means not shown) to the position as shown in the full-line position and is capable of anti-clockwise rotation, when the shutter 12 is open, to the dotted-line position, thereby to free the lip 10 and to permit upward movement of the lid. Cut-out portions are provided in the bridge piece 31 and the bracket 35 to permit said rotation. It will thus be appreciated that it is only possible to open the lid when the shutter 12 is retracted and, furthermore, that the groove 34 aligns with the side channel guideways 13 and 14 to retain the shutter which locks the slidable plates 21 and prevents pivotal movement of the bridge piece 31.

The support for the stack of banknotes S comprises a horizontal plate 36 which is secured to the interior of the side panels and to the top of the flanged brackets 28.

The plate is provided with a central longitudinal slot to receive a grooved block 37 (FIG. 3) forming a part of a slidable pressure plate assembly 38. This assembly is spring-biassed in a well known manner (by means not shown) to provide a leftward force upon the rear face of the stack. The front of the plate 36 is provided with a pair of light-force leaf separator springs 39 to restrain the forward lower edge of the stack (see FIG. 2). To control upward and lateral movement of the stack there is provided a pair of guide strips (one of which is shown by symbol 40). These strips are secured to the horizontal plate 36 in an adjustable manner to conform to a variety of banknote sizes. The upper surface of the stack is supported in a similar manner by further strips 41 which are secured to the underside of the lid through the medium of brackets 42 having elongated holes.

The cassette is supported in the dispenser by a pair of longitudinal support strips 43 (FIGS. 1 and 2) which are secured to the exterior of the side panels and which engage in complementary runners provided in the framework of the apparatus.

The locking and latching mechanism of the cassette will now be described with additional reference to FIGS. 7–10. Between the flanged brackets 28 is provided a pair of latching pawls 44 which are rotationally mounted upon pivots 45. The pawls are linked together to turn in unison by means of a transverse rod 46 which terminates at a protrusion 47. Each pawl includes a notch 48, a stop surface 49*a* and a double chamfered portion 49 on its lower edge. The notch 48 and stop surface 49*a* serve to retain the transverse bar member 24 and the chamfered portions 49 to receive movement from the same during movement of the shutter. Inwardly of the bracket 28 there is a slidable locking bar 50 having a chamfered end 51 and upper notch 52 at one end, and an abutment face 53 at the other end. The bar is aligned with respect to the protrusion 47 so that leftward movement, against action of a tension spring 54, lifts it vertically and finally retains it in the notch 52 (see FIG. 8). The bar is moved in a leftward direction by means of a crankpin 55 attached to a disc 56 which is rotated by means of a key and lock, 57 and 58 respectively. Attached to the side of the locking bar 50 there is provided a visual indicator device comprising a two-colour indicator plate having a green portion G and a red portion R. The device serves to inform the user of the cassette that the mechanism is, or is not, in a pre-set condition, either of the two colours being visible through an observation window 59 formed in the side panel 3 (see FIG. 2).

OPERATION OF THE CASSETTE

Manual loading of the cassette is facilitated by the provision of a bench rig comprising two shutter-actuating rods 30 mounted upon a transverse bar member as shown at the left hand side of FIG. 1. The bar is attached to a suitable bed plate so that the actuating rods 30 align with the clearance holes at the front of the cassette.

To open the cassette it is first necessary to insert the key into the lock 58, turn it momentarily through 360° and remove the key. This effectively sets the latching mechanism in the position shown in FIG. 8. Thereafter the cassette is moved up to the bar member and the shutter-actuating rods 30 enter into the cassette to bear upon the lugs 29 of the anchor strip 23 and to open the shutter. During movement of the anchor strip 23, the transverse bar member 24 (which is attached thereto) engages the chamfered surface 49 and rotates the pawl 44 in an anti-clockwise direction, to the position shown in FIG. 9, which lifts the protrusion 47 from the notch 52 and permits the locking bar to move rightward by action of the spring 54 to the position shown in FIG. 10. Retraction of the shutter 12 frees the bridge piece 31 and permits the operator to turn it anti-clockwise and thereafter to open the lid of the cassette.

The pressure plate assembly 38 is then manually retracted and the cassette loaded with banknotes.

Upon closing the lid the lip 10 rides over the bridge piece 31 and snaps into the groove 33 thereby to lock the lid. Thereafter the cassette is withdrawn from the bench rig and the spring 26 closes the shutter; this effectively reverts the latching mechanism to the condition shown in FIG. 7 (via FIG. 10).

The cassette is thus in a fully locked condition and to enable it to be used in a banknote dispenser it must first be "primed" or pre-set by an authorised person. This is effected by a 360° rotation of the key 57 to set the latching mechanism to the condition of FIG. 8. The green portion G of the indicator will now be visible through the observation window 59 to inform a user that the cassette is ready for use.

When the casette is introduced into the banknote dispenser the above described sequence of operation of the latching mechanism is repeated and, in addition, the sliding plates 21 will be retracted by the feeding arm shaft after the shutter has passed below the slots 20 (see FIGS. 2 and 4). The red portion R of the indicator will then be visible through the observation window 59.

If the cassette is removed from the dispenser the sliding plates 21 and the shutter 12 will close automatically and the latching mechanism (FIG. 7) will prevent re-insertion or opening of the shutter (due to stop surface 49*a*) or the lid until the key is used to re-set the mechanism.

It will thus be seen that by means of the above described invention the contents of the cassette are safeguarded against pilfering and, furthermore, if the cassette is forcibly opened, it will be readily apparent.

Whilst the preferred embodiment of the invention shows a vertically movable single shutter, it could obviously be substituted by one, or a pair of, horizontally movable shutters. Furthermore, a door-type shutter could be substituted for the slatted type as shown, provided that it is capable of being accepted by the sheet handler.

What is claimed is:

1. A security cassette comprising:

(a) a casing constructed so as to encompass a stack of sheets;

(b) support means to support the stack of sheets within said casing;

(c) a wall at one end of the casing with a sheet access aperture within said wall of said casing to permit transmission of said sheets into and out of the cassette;

(d) movable shutter means arranged when in a first position to obstruct said aperture and when in a second position to permit transmission of said sheets;

(e) mechanism to move said shutter means from said first position to said second position when actuated by external actuation means, said mechanism being arranged to return the shutter means from the second position to the first position when said external actuating means is removed;

(f) latching means to prevent further movement of said shutter means after its return to said first position; and (g) manually operable means to release said latching means.

2. A cassette according to claim 1 and in which said movable shutter means comprises at least one pivotally mounted flap or door panel disposed or vertical or horizontal axes arranged to move externally of the stack of sheets.

3. A cassette according to claim 1 in which said movable shutter means comprises one or more door panels arranged to slide in a direction parallel to the front face of the stack.

4. A cassette according to claim 3 on which the shutter means is of flexible or slatted construction.

5. A cassette according to claim 4 and in which the shutter means comprises an assembly of side interlocking strips the ends of which are adapted to slide between parallel channel section guideways.

6. A cassette according to claim 1 in which the shutter means is spring biased to its first position and said actuating means comprises a pair of parallel rods cantilevered from a face of a sheet handling machine, the extremities of the rods being arranged to enter into the interior of the cassette via holes formed in the front thereof.

7. A cassette according to claim 6 and in which in operation, during introduction of the cassette into a sheet handling machine, the said rods pass through said holes and engage a slidable transverse bar to which is attached a part of the shutter means.

8. A cassette according to claim 1 and in which the latching means comprises a spring biased pawl which is arranged to engage with a component adapted for movement with said shutter means.

9. A cassette according to claim 1 and in which the manually operable means comprises a conventional key operated lock so arranged that use thereof frees the latching means.

10. A cassette according to claim 9 in which a spring biased slidable bar is arranged to free the interengagement between the pawl and said component during operation of the key and thereafter to be retained by interengagement between the bar and the pawl thereby to preset the latching mechanism.

11. A cassette according to claim 10 in which an additional security is provided by a second key operated lock together with a second associated slidable bar the arrangement involving the use of two keys to preset the mechanism for use or to gain access to the interior of the cassette.

12. A cassette according to claim 1 in which indicator means are provided to inform a user that the latching mechanism is in a preset condition.

13. A cassette according to claim 12 and in which the indicator means is in the form of a colour coded device attached to a movable part of the latching mechanism and visible through an aperture formed in the casing of the cassette.

14. A cassette according to claim 1 and in which audible indicator means is provided to create a sound upon the transition of the latching means from its preset to its latched condition.

15. A cassette according to claim 1 provided with a movable lid component to permit internal access.

16. A cassette according to claim 15 in which the lid may be locked by a conventional key means or may be locked automatically when the shutter means is in its first i.e. closed position.

* * * * *